US006711097B1

(12) United States Patent
Engdahl

(10) Patent No.: US 6,711,097 B1
(45) Date of Patent: Mar. 23, 2004

(54) DRIVING DEVICE FOR A HYDROACOUSTIC TRANSMITTER

(75) Inventor: Göran Engdahl, Taby (SE)

(73) Assignee: Cetus Innovation AB, Vasteras (SE)

( * ) Notice: Subject to any disclaimer, the term of this patent is extended or adjusted under 35 U.S.C. 154(b) by 0 days.

(21) Appl. No.: 10/048,331

(22) PCT Filed: Jun. 16, 2000

(86) PCT No.: PCT/SE00/01266

§ 371 (c)(1),
(2), (4) Date: Jan. 25, 2002

(87) PCT Pub. No.: WO01/12345

PCT Pub. Date: Feb. 22, 2001

(30) Foreign Application Priority Data

Aug. 13, 1999 (SE) ..... 9902894

(51) Int. Cl.[7] ..... B06B 1/02
(52) U.S. Cl. ..... 367/174
(58) Field of Search ..... 367/163, 174; 310/337

(56) References Cited

U.S. PATENT DOCUMENTS 3,749,948 A 7/1973 Morris
3,972,018 A 7/1976 Erickson
4,236,235 A 11/1980 Gilbert
6,465,936 B1 * 10/2002 Knowles et al. ..... 310/337

FOREIGN PATENT DOCUMENTS

GB 2112249 7/1983

* cited by examiner

*Primary Examiner*—Daniel T. Pihulic
(74) *Attorney, Agent, or Firm*—Harness Dickey & Pierce P.L.C.

(57) ABSTRACT

The invention refers to a driving device for hydroacoustic transmitters, including at least one actuating element (1), arranged to execute a reciprocating movement, wherein the movement of the actuating element (1) includes an increase and a decrease of the distance between two ends thereof, and at least one spring member (5, 27) which is connected to the actuating element (1) at said ends and which extends along a curved line between said ends, wherein the increase and the decrease of the distance between said ends result in a change of the curve of the spring member (5, 27) and thereby a movement of it. The device includes an element (12, 13, 28) for displacement of a mass, which displacement element (12, 13, 28) is connected to the spring member (5, 27) so that the movement of the latter is transmitted to the displacement element (12, 13, 28) and generates a displacement thereof, resulting in said mass displacement. Furthermore, the invention refers to the use of such a device for transmitting hydroacoustic waves in a liquid.

15 Claims, 4 Drawing Sheets

DRIVING DEVICE FOR A HYDROACOUSTIC TRANSMITTER

FIELD OF THE INVENTION

The present invention refers to a driving device for hydroacoustic transmitters, including at least one actuating element, arranged to execute a reciprocating movement, wherein the movement of the actuating element includes an increase and a decrease of the distance between two ends thereof, and at least one spring member which is connected to the actuating element at said ends and which extends along a curved line between said ends.

Advantageously, the driving device can be employed to drive different types of acoustic apparatuses. Such apparatuses may work both as transmitters of acoustic signals and as receivers of acoustic signals. An acoustic apparatus, where the invention with great advantage may be of use is as a so-called sonar, i.e. a transmitter which sends sound waves under water, which waves after reflection can be monitored by hydrophones of different types.

However, the field of the invention may not only include acoustic apparatuses. The device may well be employed for other purposes than sound transmission. For instance, it can be employed for mechanical machining under water or for driving a hydraulic pump.

In the first place, however, the device is suitable for generation of low-frequent sound waves and is applicable on powerful low-frequent sound transmitters, which can work underwater.

The field of the invention also comprises applications of seismology and tomography. It refers to different arrangements, which in an active state are intended to be arranged completely below a liquid surface, for instance the water surface of a lake or a sea, in order to generate pressure waves in the water by moving quantities of water.

THE BACKGROUND OF THE INVENTION AND PRIOR ART

Most acoustic transmitters that are used nowadays are based either on the piezoelectrical effect or on magnetostriction. The piezoelectrical effect implies that a crystalline material presents a change of length when an electric voltage is applied to its end surfaces, and that an electric voltage ss obtained when the material is subjected to a physical deformation. Magnetostriction implies that a magnetic material, which is subjected to a change of the magnetic flux, presents a change of length and that an outer, onto the material forced change of length, causes a change of the magnetic flux. This implies that transmitters utilizing these effects also principally may be used as receivers.

Traditional driving devices for hydroacoustic transmitters can, on one hand, be of the type which is used for piston transmitters, and on the other hand of the type which is used for so-called flextensional transmitters. Driving devices for piston transmitters, normally include actuating elements which include piezoceramics or magnetostrictive materials. Normally, a clamp bolt is employed to pre-stress such piezoceramics or magnetostrictive materials and to adjust resonance frequencies for the transmitter. The piston which is driven by the driving device can be directly connected to said piezoceramics or magnetostrictive materials.

Also in driving devices for flextensional transmitters, the actuating element consists of piezoceramics or magnetostrictive materials. Here as well, a clamp bolt can be employed to pre-stress the piezoceramics or the magnetostrictive material and to adjust the resonance frequency for the transmitter. In the case of flex-tensional transmitters, the shell which is driven by the driving device and which is to act directly against a surrounding liquid is preferably connected to the actuating element at opposite end sections thereof. The shell can be in the form of a pre-stressing mechanism, whereby the need of a clamp bolt is eliminated.

When the shell is designed as described above and attached to opposite ends of the actuating element, the length oscillation of the actuating element will result in a corresponding change of the bulging of the shell. The described construction results in an amplification of the movement of the actuating element in the shell, so that a small movement of the actuating element results in a relatively large movement of at least some parts of the shell. When the shell is in direct contact with and surrounded by a liquid, its movements thus result in a displacement of the surrounding mass of liquid and a generation of hydroacoustic waves. The shell has double functions, one of which is to act as a spring member and in the best possible way amplify the movements of the actuating element, and the other to act as a displacement element against the surrounding liquid.

However, the shell presents a number of modes of oscillation, depending i.a. on its shape, deadweight and stiffness. The frequency characteristic of the shell, i.e. how it moves at different frequencies, can thus be influenced by the design of the shell. At certain frequencies, however, interferences between higher modes are obtained, which leads to the fact that the efficiency of the device at such frequencies is strongly reduced. Normally, the present transmitters have difficulties to generate high amplitudes below 100 Hz without said transmitters having to be large and complex due to the limited amplitude of the driving device.

SUMMARY OF THE INVENTION

An object of the present invention is to provide a driving device which in particular is suitable for transmission of hydroacoustic waves and which efficiently utilizes the movements of an actuating element to accomplish a displacement of a mass and thereby a generation of hydroacoustic waves. A large displacement shall be accomplished by utilizing a relatively small movement of the actuating element. The device can be made relatively small and simple. Furthermore, it should allow large amplitudes and a good control of its frequency characteristic.

This object is achieved by means of a device of the initially defined kind, which is characterized in that it includes an element for displacement of a mass, which displacement element is connected to the spring member so that the movement of the latter is transmitted to the displacement element and generates a displacement thereof resulting in said mass displacement.

Thanks to the use of a separate displacement element, it is possible to work with further a mass and a stiffness, i.e. the mass and stiffness of the displacement element, to control the frequency characteristic of the device. The design of the displacement element, for instance its stiffness and shape, can be optimized with respect to the effective displacement of, for instance, a mass of liquid, while the stiffness of the spring member and the shape of the spring member can be optimized with respect to the desired pre-stress of the driving element and the maximum movement in the area where it is connected to the displacement element. Thus, the transmission ratio of the movement of the actuating element can be optimized.

According to a preferred embodiment, the displacement element is connected to the spring member in an area where the movement of the spring member occurs substantially perpendicularly to the reciprocating movement of the actuating element. Thereby, the largest possible displacement should be obtained thanks to an optimization of the transmission ratio change up of the movement of the actuating element.

According to a further preferred embodiment, the spring member, depending on the frequency of the movement of the actuating element, presents one or more modes of oscillation, the displacement element is connected to the spring member in an area where its bulge appears in the fundamental mode of the spring member. The spring member includes preferably a structure which provides a transmission ratio of the movement of the actuating element and can have the form of at least a part of an ellipse, whereby its bulging is influenced by the movement of the actuating element. The structure is preferably continuous and surrounds and encloses the actuating element.

According to a further preferred embodiment, the device includes at least one transmission element, via which the spring member is connected to the displacement element and via which the movement of the spring member is transmitted to the displacement element and generates a displacement thereof, which results in said mass displacement. Advantageously, the transmission element can be one or more rods or the like, which at one of the ends is/are attached to an, in a movement point of view, optimal part of the spring member and at an opposed end is/are attached to an advantageous part of the displacement element. Also the mass of the transmission element can be utilized to control the frequency characteristic of the device. Thus, the displacement element can be employed to provide a larger transmission ratio of the device, especially if it, via the transmission element, is connected to the part of the spring member where its reciprocating movement is the largest and most reliable with respect to interference etc. At generation of hydroacoustic waves, the displacement element may, for instance, be a stiff plate, which is displaced perpendicularly to its plane of propagation, and acts against a liquid. The area of the plate does principally not have to be limited by the size or length of the actuating element or the size or the length of the spring member, and thanks to its shape and stiffness, interference problems are avoided, which easily appear when an elliptical structure is operating both as a spring member and a displacement element.

According to a further preferred embodiment, the device includes a container, inside which the actuating element and the spring member are arranged, and outside which the displacement element is arranged. A transmission element can advantageously be arranged so that it tightly penetrates a wall of the container. Thanks to the described design, the spring member and the actuating element are protected against direct outer influence. Preferably, the container is impermeable and filled with a gas-like medium or vacuum. Provided that the container is of a rigid design, the device can be conveyed down to a large depth in the liquid, and the actuating element as well as the spring member will be well protected against outer agitation, for instance powerful pressure waves, caused by under-water explosions or the like. Thanks to the fact that the driving element and the spring member are surrounded by a gas or vacuum, the spring member can operate without directly being affected by any resistance from a surrounding liquid.

According to a further preferred embodiment, the device includes a substantially immovable fixture, which sealingly surrounds the displacement element and relatively which the latter is displaced during its displacement movement, and includes a resilient membrane which between itself and the displacement element encases a gas and is attached to said fixture, whereby the membrane and the encased gas are arranged between the displacement element and the wall, which the transmission element goes through. When the device is immersed into a liquid and the surrounding liquid pressure increases, the gas pressure between the membrane and the displacement element will increase. Since the membrane and the encased gas are arranged between the displacement element and the wall which the transmission element goes through, the gas pressure will counteract that the displacement element is displaced towards the spring member and influences it with a force due to the increased surrounding liquid pressure. To achieve this effect, the device must be designed with channels or the like to admit liquid, which surrounds the device, entrance to a space between the membrane and said wall. By such an arrangement of the fixture, the flexible membrane, and the gas, a self-compensating pressure equalization is achieved, resulting in the fact that the function of the device can be made independent of the application depth. Furthermore, the actuating element and the spring member are protected against violent shocks, or the like from outside for instance from pressure waves caused by under-water explosions, or the like.

When the device defines a hydroacoustic transmitter, the displacement element is provided with preferably two opposite sides, one of which faces a surrounding liquid to be displaced and the other faces said gas, whereby said sides have substantially the same area. In such a way, a good self-compensating pressure equalization and a stabilization of the device are achieved.

Further features of and benefits with the device according to the invention will be seen from the following detailed description and from the appended claims.

BRIEF DESCRIPTION OF THE DRAWINGS

An example of an embodiment of the device according to the invention is hereafter described with reference to the attached drawings, in which.

DETAILED DESCRIPTION OF PREFERRED EMBODIMENTS OF THE INVENTION

Figure 1:
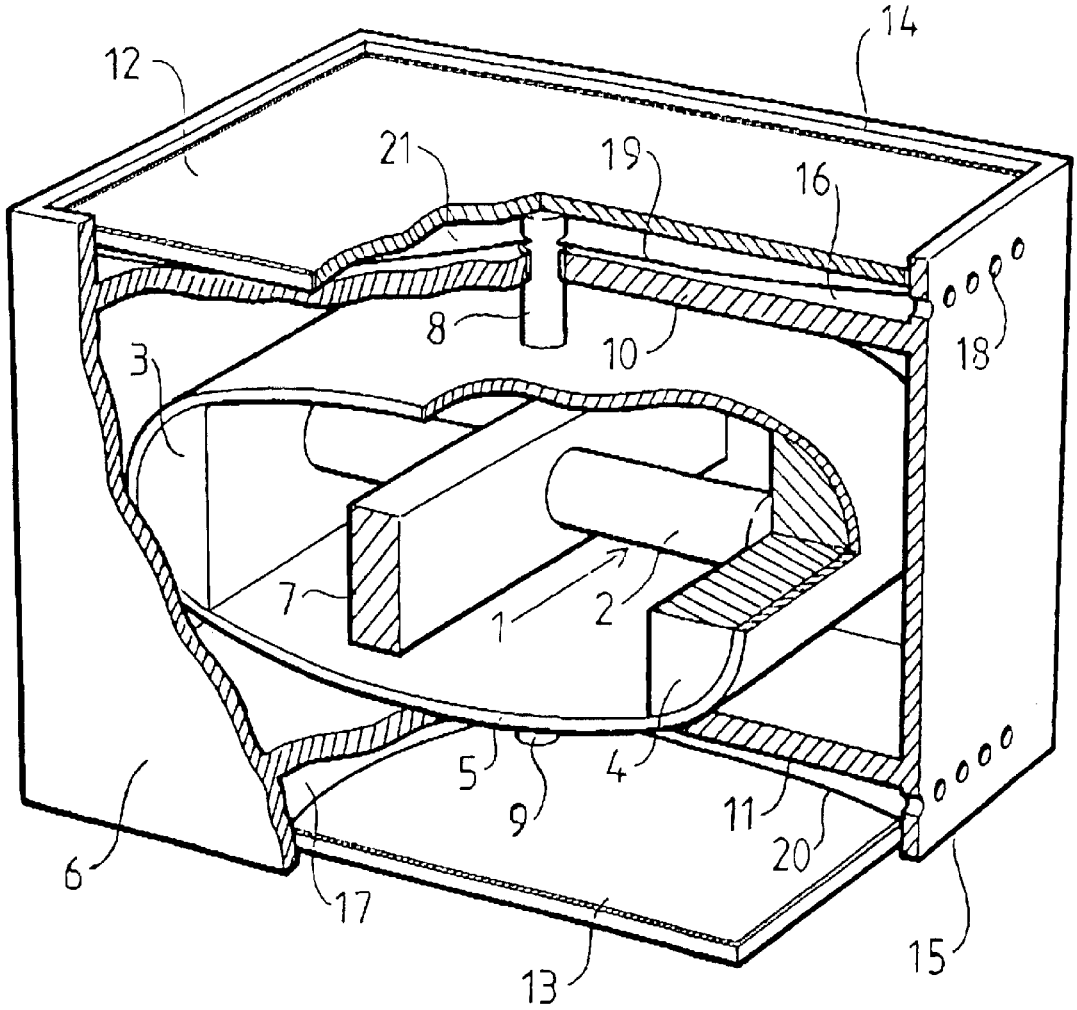
FIG. 1 is a partly cut, schematic perspective view of an embodiment of the device according to the invention.
Figure 2:
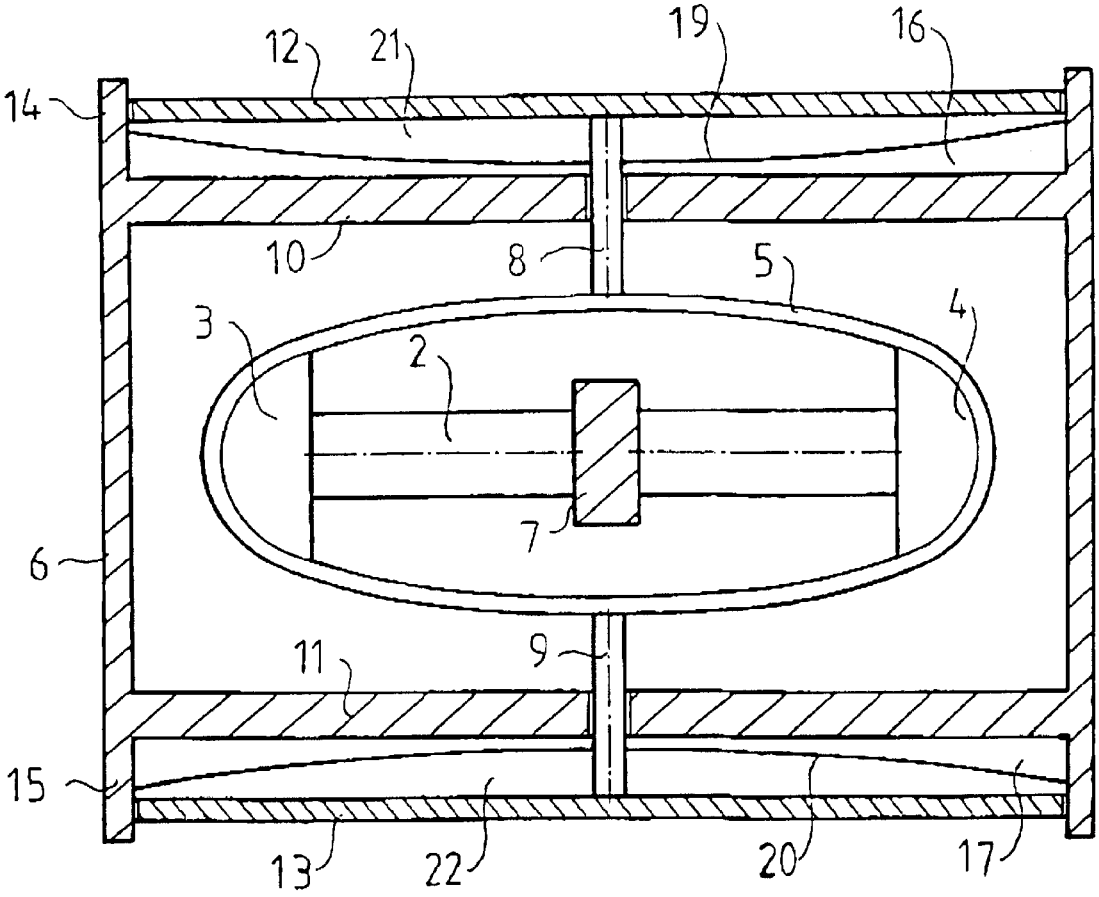
FIG. 2 is a cross-sectional view seen from the side of the device according to FIG. 1.

FIGS. 1 and 2 disclose a first embodiment of the device according to the invention. The device includes here an actuating element 1 formed by a piezoelectric or preferably a magnetostrictive actuator. Alternatively, the device can include more actuating elements 1 to provide the device with better stability and balance. Known per se, the actuator includes a magnetostrictive or piezoelectric rod 2 of a material suitable for the purpose. Such a rod can be divided into several shorter sections in cases where it is considered suitable. In the disclosed embodiment, the actuating element is a magnetostrictive actuator with a magnetostrictive rod 2. Known per se, such an actuator includes means (not shown) for application of a magnetic field on the rod 2, so that it is elongated and shortened, respectively, in its longitudinal direction, i.e. oscillates. However, other types of actuating elements, with which a pulsating change of length can be accomplished, are also possible.

At two opposite ends of the actuating element 1, a beam 3, 4, respectively, is arranged. These extend transversally the longitudinal direction of the rod 2 and have, among other things, the purpose to form a support surface for the actuating element 1. The beams 3, 4 have a rounded or curved outer periphery turned away from the actuating element 1. A spring member 5 defines a structure, in this case a cylindrical shell with an elliptical cross-section, which extends around the actuating element 1 and the beams 3, 4. The spring member 5 can, for instance, be made of a metal, or preferably, a glass fiber or carbon fiber laminate and is preferably supported by the rounded, outer periphery of the beams 3, 4. The spring member is preferably pre-stressed so that a compressive stress is applied on the rod 2 of the actuating element 1. Alternatively, the beams 3, 4 might be an integrated part of the spring member 5.

The actuating element 1, the beams 3, 4, and the spring member 5 are arranged in an tight container 6. The container 6 is preferably filled with an inert gas with respect among other things to formation of sparks of the electrical components which might to exist in the actuating element 1. The actuating element is connected to a support member 7 which in its turn is rigidly connected to the container 6. In this case, the support member 7 is constituted of a beam or the like extending crosswise through the container 6 and is connected to opposed sides thereof.

Two transmission elements 8, 9, here in the form of rods, are each at one end connected to the spring member 5 at opposed sides of the actuating element 1. Each transmission element 8, 9 is preferably attached in an area of the spring member 5, where its fundamental mode of oscillation can be expected to occur, when the spring member 5 is put into to oscillation by influence of the reciprocating movement of the actuating element 1. Each of the transmission elements 8, 9 extends through an adjacent wall 10, 11 of the container 6. For this purpose, each of the walls 10, 11 includes a hole, and sealing members are preferably arranged in the boundary surface between the transmission elements 8, 9 and the surrounding wall 10, 11. The transmission elements 8, 9 displaceably arranged relative to the walls 10, 11 and can thus slide in their respective holes.

At their opposed ends, i.e. the ends which are not connected to the spring member 5, the transmission elements 8, 9 are connected to a respective element 12, 13 for displacement of a mass, in this case a mass of liquid, in order to accomplish a generation of hydroacoustic waves. The driving device is substantially symmetrical and the displacement elements 12, 13 will be displaced in opposite directions and thus influence the surrounding liquid in opposite directions. Each of the displacement elements 12, 13 includes, in this case, a disc, the plane of propagation of which is substantially perpendicular to the longitudinal direction and/or movement direction of the transmission elements 8, 9. By the movement of the transmission elements 8, 9, which is a direct consequence of the oscillating movements of the actuating element 1 and the spring member 5, the displacement elements 12, 13 are displaced back and forth in a direction substantially parallel with the displacement or movement direction of the transmission element. This is substantially perpendicular to the length change direction of the actuating element 1.

The displacement elements 12, 13 are surrounded by and lie sealingly to a respective fixture 14, 15, which in this case are formed by an elongation of those side walls of the container 6 that adjoin the walls 10, 11. Together with the fixtures 14, 15, and the walls 10, 11, the displacement elements 12, 13 encases a cavity 16, 17, respectively. One or, as in this case, a plurality of openings or channels 18 in the fixtures 14, 15 allow the cavities 16, 17 to communicate with a liquid surrounding the device, so that the liquid is allowed to flow into and out of the cavities 16, 17.

Inside the cavities 16, 17, at each displacement element 12, 13, a gas- and liquid-impermeable, flexible membrane 19, 20 is connected to the fixture 14, 15 along its inner periphery. In a space 21, 22 between the membrane 19, 20 and the displacement element 12, 13, a gas is encased. The arrangement of the membrane 19, 20 and the gas results in a self-compensating pressure equalization of the device. Thus, the depth of immersion will not influence the force, by which the displacement element 13, 14 influences the spring member 5 and thereby the pre-stress of the actuating element 1. The driving device obtains a shock resistance, foremost thanks to the fact that the force from a pressure wave merely to a modest extent is transmitted to the actuator due the pressure compensation. The fact that the actuator is arranged in a container also contributes to an increased shock resistance.

Figure 3:
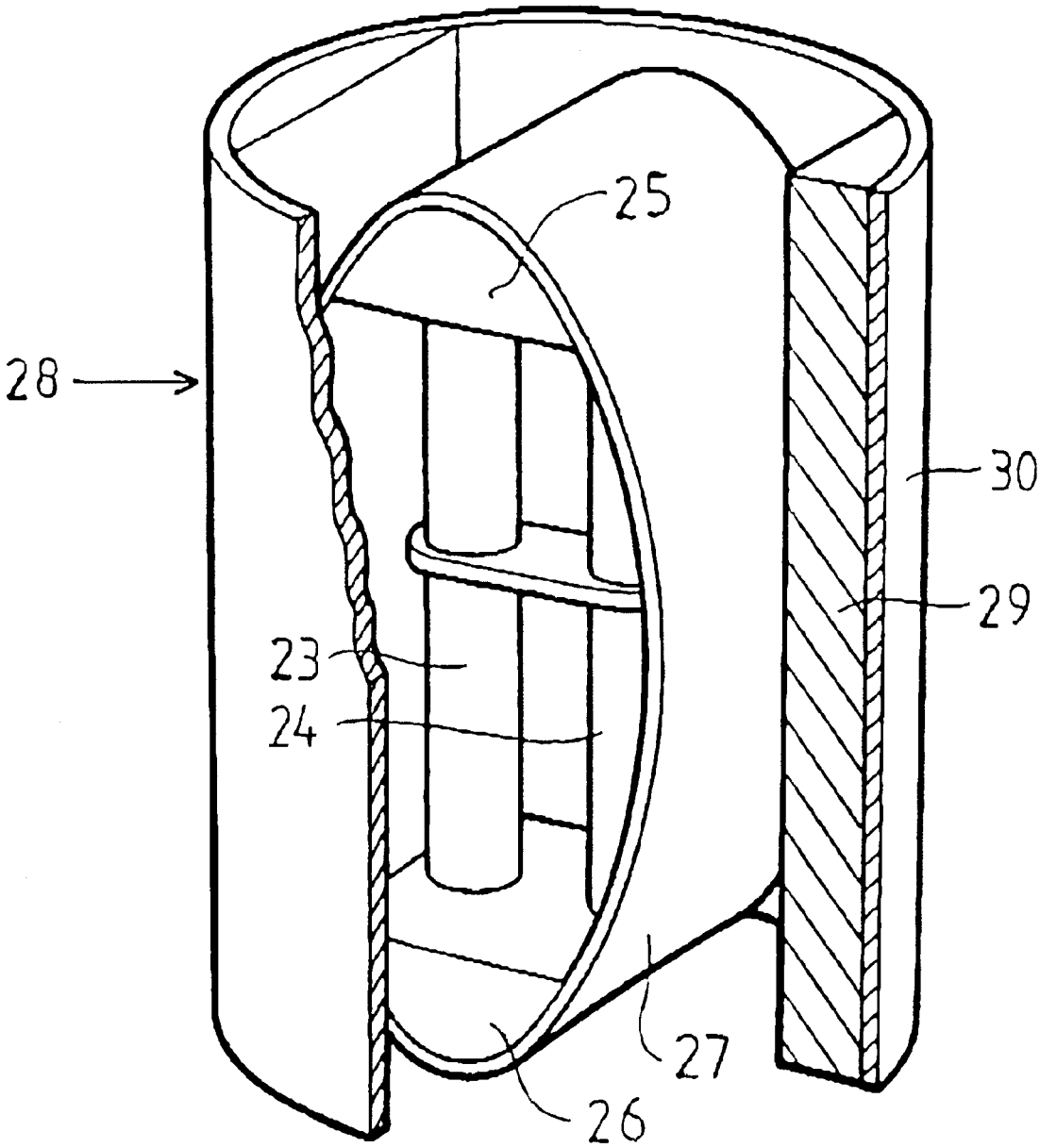
FIG. 3 is a partly cut, schematic perspective view of an alternative embodiment of the device according to the invention.
Figure 5:
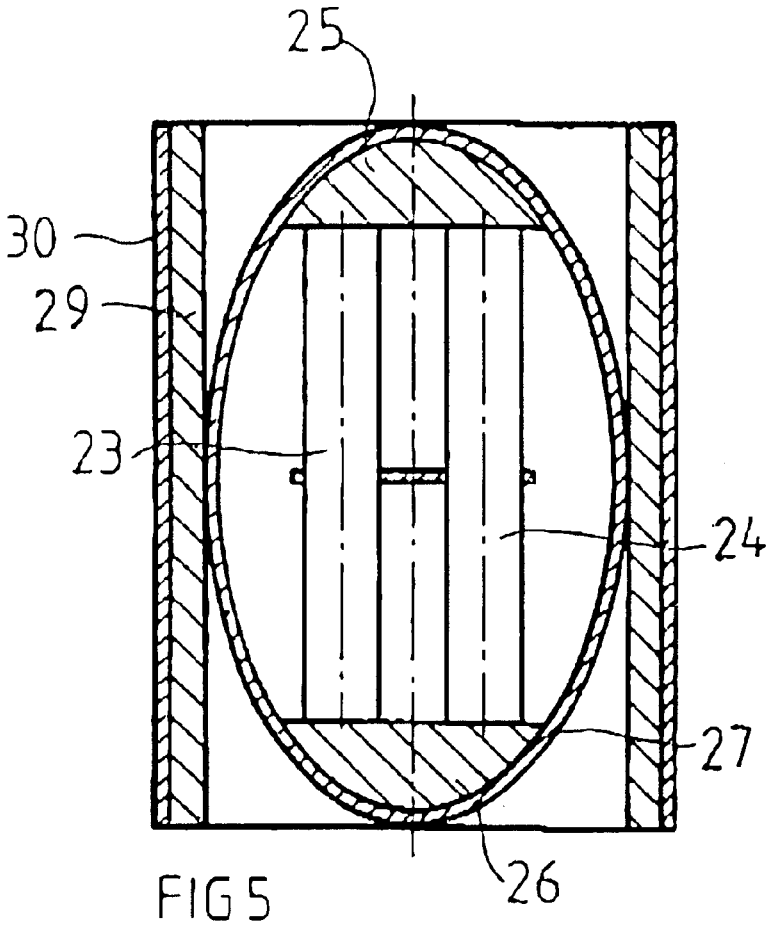
FIG. 5 is a cross-sectional view from the side of the device according to FIGS. 3 and 4.
Figure 4:
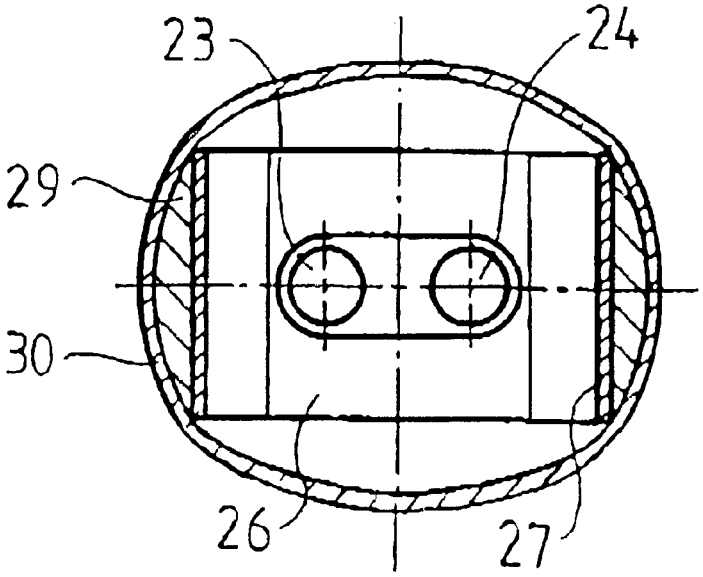
FIG. 4 is a cross-sectional view from above of the device according to FIG. 3.

FIGS. 3–5 disclose an alternative embodiment of the device according to the invention. The actuating element 1 includes here, two magnetostrictive rods 23, 24, support beams 25, 26, and a spring member 27, arranged in substantially the same manner as in the first example of the embodiment. However, in this case, the device includes only one displacement element 28, which includes a substantially cylindrical, in opposite ends open, flexible shell 30 that surrounds the actuating element 1 and the spring member 27. The displacement element 28 includes two beams or wall sections 29, arranged opposed to each other, which bear on and extend along two opposite sections of the inner periphery of the shell 30. The beams 29 are to take up force from the spring member 27 and transmit that force to the shell 30. The shell 30 has a center axis which extends substantially in the same direction as the length change direction of the actuating element 1. The change of length of the actuating element 1, i.e. the back and forth movement in said direction, results in a corresponding but larger movement of the spring member 27 in a direction perpendicular to said length change direction. The spring member 27 is arranged to bear on the beams 29 in an area, where a bulge can be expected to occur in the spring member 27 at its fundamental mode of oscillation. Accordingly, the spring member 27 bears on the beams 29 along opposed lines substantially in the center of respective spring half and substantially perpendicular to said length change direction. This can be seen in FIGS. 3–5. Accordingly, the displacement element 28 with the shell 30 defines here a so-called flex-tensional shell, which advantageously can be employed as a hydroacoustic transmitter. Unlike flextensional transmitters according to prior art, the structure forming the spring member 27 does however not operate as a displacement element, but can be optimized for its spring function. The displacement element 28, on the contrary, is optimized for the displacement function. A maximal transmission ratio can in such a manner be achieved. Considerably higher amplitudes than according to prior art can thereby be achieved.

It should be realized that different alternative embodiments of the device according to the invention of course will be obvious to a person skilled within this field without leaving the scope of the invention, as it is defined in the appended claims supported by the description and the drawings.

For instance, the beams 29 in the second embodiment may be considered as transmissions elements, while the shell 30 solely is considered as a displacement element.

The number of actuating elements 1, rods 2, 23, 24, transmission elements 8, 9, etc. should in each individual case be optimized with respect to the rest of the design and operation conditions of the device.

The term structure should be seen in a wide sense and primarily include all constructions/components which, when connected to the actuating element in the described manner, may accomplish a transmission ratio of the movement of the actuating element. For instance, it can include a hinge mechanism.

What is claimed is:

1. A driving device for hydroacoustic transmitters, comprising:

at least one actuating element, arranged to execute a reciprocating movement, wherein the movement of the actuating element includes an increase and a decrease of the distance between two ends thereof, and at least one spring member which is connected to the actuating element at said ends and which extends along a curved line between said ends, wherein the increase and the decrease of the distance between said ends result in a change of the curve of the spring member and thereby a movement of it, the actuating element including, an element for displacement of a mass, which displacement element is connected to the spring member via at least one transmission element so that the movement of the latter is transmitted to the displacement element and generates a displacement thereof, resulting in said mass displacement, a container, inside which the actuating element and the spring member are arranged and outside which the displacement element is arranged, and the at least one transmission element, via which the spring member is connected to the displacement element and via which the movement of the spring member is transmitted to the displacement element and generates a displacement thereof, which results in said mass displacement and that the transmission element extends through an adjacent wall of the container; and a substantially immovable fixture, which sealingly surrounds the displacement element and relatively which the latter is displaced during its displacement movement, and that a resilient membrane, which between itself and the displacement element encases a gas, is attached to said fixture, whereby the membrane and the encased gas are arranged between the displacement element and the wall, which the transmission element goes through.

2. A device according to claim 1, wherein the displacement element is connected to the spring member in an area where the movement of the spring member occurs substantially perpendicularly to the reciprocating movement of the actuating element.

3. A device according to claim 1, wherein the spring member, depending on the frequency of the movement of the actuating element, presents one or more modes of oscillation, and the displacement element is connected to the spring member in an area, where its bulge appears in the fundamental mode of the spring member.

4. A device according to claim 1, wherein the spring member includes a structure which provides a mechanical transmission ratio of the movement of the actuating element.

5. A device according to claim 1, wherein the spring member defines a continuous structure that surrounds the actuating element.

6. A device according to claim 1, wherein said mass is a liquid, and that the displacement of the liquid results in a generation of hydroacoustic waves.

7. A device according to claim 1, wherein the transmission element goes tightly through a wall of the container.

8. A device according to claim 1, wherein the spring member is surrounded by a gas or arranged in a vacuum.

9. The use of a device according to claim 1 for transmitting hydroacoustic waves in a liquid.

10. A device according to claim 1, wherein the displacement element has two opposite sides and that one of these faces a liquid, which is to be displaced, and the other faces said gas, whereby said sides have substantially the same area.

11. A device according to claim 10, wherein the device includes channels for admitting liquid, which surrounds the device when it is used as a hydroacoustic transmitter, entrance to a space between the membrane and said wall.

12. A device according to claim 1, wherein the container defines a box and that the fixture is formed by wall sections which are connected to and surround the wall which the transmission element goes through.

13. A device according to claim 1, wherein the device is substantially symmetrically shaped.

14. A device according to claim 1, wherein the actuating element is an electromechanical actuator, which includes a magnetostrictive or piezoelectrical actuator.

15. A device according to claim 14, wherein the electromechanical actuator includes at least one magnetostrictive or piezoelectrical rods, pre-stressed by the action of the spring member.

* * * * *